United States Patent [19]

Kling

[11] 4,110,059

[45] Aug. 29, 1978

[54] PUMPING DEVICE

[76] Inventor: Miguel Kling, Am Hugel 14, 8136 Percha, Fed. Rep. of Germany

[21] Appl. No.: 715,660

[22] Filed: Aug. 19, 1976

[30] Foreign Application Priority Data

Dec. 18, 1975 [DE] Fed. Rep. of Germany ..... 2557202

[51] Int. Cl.[2] ..... F04B 17/00

[52] U.S. Cl. ..... 417/424; 415/198.1; 417/420; 310/115

[58] Field of Search ..... 417/424, 350, 352–356, 417/348, 405, 406, 420, 426, 62, 410, 423, 429; 415/60–69, 75, 98, 101, 198.1; 310/115

[56] References Cited

U.S. PATENT DOCUMENTS

| | | | |
|---|---|---|---|
| 649,065 | 5/1900 | Martens | 417/355 |
| 2,113,213 | 4/1953 | Leonard | 417/355 |
| 2,406,959 | 9/1946 | Millard | 417/356 |
| 2,700,343 | 1/1955 | Pezzillo, Jr. | 417/357 |
| 2,747,512 | 5/1956 | Fouche | 417/357 |
| 2,753,806 | 7/1956 | White | 417/357 |
| 2,824,520 | 2/1958 | Bartels | 417/424 |
| 2,944,785 | 7/1960 | Sampietro | 415/174 |
| 2,952,787 | 9/1930 | Moore | 310/115 |
| 3,199,772 | 8/1965 | Leutzinger | 415/101 |
| 3,252,023 | 5/1966 | Schmidt | 310/115 |
| 3,267,311 | 8/1966 | Zamparty | 310/115 |
| 3,430,921 | 3/1969 | Dewey | 417/348 |
| 3,433,163 | 3/1969 | Sheets et al. | 417/353 |
| 3,719,436 | 3/1973 | McFarlin | 417/356 |
| 3,972,652 | 8/1976 | Travisis et al. | 417/356 |

FOREIGN PATENT DOCUMENTS

| | | | |
|---|---|---|---|
| 232,143 | 7/1963 | Austria | 417/368 |
| 1,528,804 | 9/1970 | Fed. Rep. of Germany | 415/122 A |
| 2,557,202 | 6/1977 | Fed. Rep. of Germany | 417/423 |

*Primary Examiner*—C. J. Husar

*Attorney, Agent, or Firm*—Stevens, Davis, Miller & Mosher

[57] ABSTRACT

An electrical pumping device comprising at least two coaxially rotatable pump impellers, at least two coaxial separate passageways, one impeller positioned within each passageway, pole support parts attached to each of said impellers, said pole support parts forming a part of at least one electromotor and distributed about the axis of rotation in a radially spaced relation.

15 Claims, 4 Drawing Figures

PUMPING DEVICE

This invention relates to a pumping device.

Pumping devices for conveying many different media are known. These known pumps, however, only permit the conveyance of a single medium in a passageway. When a plurality of media must be transported simultaneously, a plurality of pumps arranged in proximate relation must be employed. This gives rise to difficulties, particularly when a very limited space is available to set up the pumps. Such is the case, for example, when drilling deep holes where on the one hand cooling and flushing medium, usually water, must be pumped down to the bottom of the hole and on the other hand where the drilling mud must be pumped up out of the drill hole. Hitherto it has been necessary to locate the pumps outside the actual bore-hole and to provide only the lines for the media to be pumped inside the bore-hole due to the limited space available in the bore-holes.

The object of the invention is therefore to provide a pumping device which has a simple structure and limited space requirements and which guarantees the conveyance of at least two streams of media in an economical and effective manner.

This object is accomplished in accordance with the invention in that the pumping device has at least two pump impellers which are disposed to be coaxially rotatable about an imaginary axis of rotation and which are located in at least two separate passageways, and that each pump impeller is respectively connected in a non-rotational manner with a pole support part of at least one electromotor consisting of at least two cooperating pole support parts, said pole support part supporting poles distributed about the axis of rotation in a radially spaced relation and being adapted to be rotatable about the imaginary axis of rotation of said pump impellers, or that each pump impeller itself forms a pole support part, the poles of at least one pole support part of each electromotor being designed as electromagnetic poles and being connected via electric leads with a voltage source, if desired via a control device for current regulation.

The pumping device in accordance with the invention has substantial advantages over the prior art. In the case of the pumping device according to the invention, a very compact mode of construction is possible, since the pumping device does not have to be driven externally by means of a drive motor, in particular an electromotor, but rather each pump impeller itself constitutes a component of an electromotor in the form of an electromotor rotor which supports poles so that the drive electromotor is included in the pumping device itself in a space-saving manner in the case of the pumping device in accordance with the invention. Due to the arrangement of at least two coaxially rotatable pump impellers which are disposed in separate passageways, it is possible in the case of the pumping device according to the invention to convey at least two media concomitantly. If more than one pump impeller is disposed in one of the passageways of the pumping device, it is possible to regulate and vary the amount of the media conveyed in this passageway within wide limits by adding or disconnecting one of these pump impellers or by regulating the speed of these pump impellers.

A favorable development of the pumping device according to the invention is achieved in that each pump impeller is disposed in a separate passageway respectively.

In such a structure, the amount conveyed in each respective passageway may be varied by regulating the speed of the respective pump impeller. Of course, there is also the constructional possibility of changing the angle of pitch of the vanes of the respective pump impeller in order to regulate the capacity of the pump.

An especially favorable development of the pumping device according to the invention is that each pump impeller together with an adjacent pump impeller form the counter-rotating parts of an electromotor by cooperation of the pole support parts connected with these pump impellers. In this development, two adjacent pump impellers respectively form the counter-rotating parts of an electromotor. A "stator" is missing in such a development of an electromotor. In place of this there are two counter-rotating "rotors", i.e., the two pump impellers, which support pole collars which act on one another mutually. By correspondingly influencing the poles of one or both of the pump impellers which function as pole supports, the speed of the pump impellers can be varied. In this development of the inventive pumping device, there is a special pump behavior in which the rotary movement of the pair of pump impellers which form a pump impeller of an electromotor depends exclusively on the torque of the counter-rotating pump impeller with the opposite effect. The capacities of the two counter-rotating pump impellers are therefore not independent of one another, but rather are connected with one another due to the fact that they form a common electromotor. A particular capacity relationship is developed in response to the electrical influence and the media to be conveyed in the passageways of the two counter-rotating pump impellers. Such a pumping device is therefore particularly suited for applications, for example, in which it is important that two or more media be conveyed in specific conveyance relationships and that these be supplied to processing stations, e.g. in chemcial or process technological installations or in the case of mixing operations.

A constructively favorable development of the pumping device in accordance with the invention is achieved in that the pump impellers are rotatably mounted within a common housing. This construction permits the counter-rotating pump impellers to be supported in a housing which is stationary with respect to its environment and which shields the movable parts from the outside.

An especially advantageous development is achieved in that each pump impeller includes a pipe with a circular cross section which is arranged coaxially with respect to the imaginary axis of rotation and on which pump surfaces are secured which project radially outwardly or radially inwardly. In this arrangement, each pump impeller constitutes essentially a circular cylindrical element with pump surfaces, e.g. pump vanes, projecting in a radially inward or radially outward direction, the individual pump impellers being coaxially slid one over the other and encompassing each other, thereby producing a substantially tubular (pipe-shaped) arrangement of the pumping device. In so doing, the passageways are designed to be circular cylindrical or circular ring cylindrical, thereby resulting in structure which is especially space-saving.

A favorable further development of a pump device according to the invention with this design is that the pipe of each pump impeller is designed as a pole support part. Such a development permits an especially space-saving, cylindrical construction of the pumping device. The pipes of two pump impellers forming the pole supports of an electromotor may be supported on one another directly. In so doing, the pump surfaces, e.g. vanes, are secured to the side of each pipe facing away from the other respective pipe so that they project radially. The poles may be provided on the outer periphery of the pipe of the internal pump impeller and on the outer periphery of the pipe of the external pump impeller.

A favorable development is also that the pump surfaces are designed as propeller vanes.

Another favorable development is that the pump surfaces are designed as screw surfaces or worm surfaces. The configuration of the pump surfaces of each pump impeller depends in particular on the medium to be conveyed.

An especially favorable construction is achieved in the inventive pumping device in which the pump impellers have a tubular (pipe-shaped) configuration in that the common housing has a circular cylindrical jacket which coaxially surrounds the pump impellers and which outwardly defines a passageway with a circular ring cross section radially outside the pipe of the outermost pump impeller as well as a support part which extends traversely to the imaginary axis of rotation and which is provided with passageway openings corresponding to the passageways of the pump impellers, said pump impellers being rotatably mounted directly or indirectly in said support part. In this development, the pumping device has the configuration of a circular cylinder. Such a pump is adapted to be introduced, for example, into a drill hole in its entirety and to be lowered therein. If desired, it can be used in this application to pump flushing water into the drill hole and to simultaneously transport the resultant drilling mud to the top. In so doing, lines which conduct the conveyed medium to its site of utilization or receive it there and return it to the pump, can be attached to the passageway openings provided in the support part of the housing which extends transversely to the longitudinal axis of the cylindrical housing.

In order that the pumping device may be connected at both ends both to supply lines as well as to discharge lines, it is favorable if the pumping device is designed such that the housing has connections for connecting lines to or from the individual passageways both at the intake of the pumping device as well as at the outlet thereof. The connections can be designed, for example, as screw thread openings with internal threads into which the connection lines may be screwed. It is also possible, however, to design such connections as hose coupling connections for example.

The pumping device in accordance with the invention may be advantageously designed such that each pump impeller is designed as a radial pump impeller. In such a development, two radial pump impellers, for example, may be arranged coaxially such that the respective axial supply to the impeller is situated on the side opposite the other impeller and the radial pump impellers come to lie with their disc-like rear walls abutting on one another. Each rear wall of each impeller may serve as a pole support wall on which poles may be arranged on a circle about the axis of rotation facing toward the poles of the other pump impeller, the two pump impellers then together forming an electromotor. It is also possible, however, to dispose two radial pump impellers coaxially such that they are aligned in the same direction and the inlet of the one pump impeller encompasses the inlet of the other pump impeller concentrically. The two radial pump impellers in this case as well can serve concomitantly as pole supports and form an electromotor together.

Irrespective of the embodiment of the inventive pumping device as a pipe pump or as a radial pump, a favorable development is attained in that the outlet end of the passageway of a pump impeller is connected with the passageway of the adjacent pump impeller via a line. In this development, the counter-rotating pump impellers operate as two pumps connected in series, both of which transport the same medium.

A favorable embodiment of the pumping device according to the invention is also achieved in that at least one pump impeller is provided whose pole support part cooperates with a pole support part stationarily secured to the housing and forms an electromotor together with said housing. A pump impeller which forms an electromotor together with the housing thus constitutes the rotor of an electromotor, while the housing constitutes the stator. The inventive pumping device may be designed such that a plurality of pump impellers respectively form pole supports which respectively cooperate with stationary pole collars attached to the housing. In this case, not pairs of pump impellers form the electromotors, but rather pairs of pump impellers with housing parts. It also is possible, however, in the case of the pumping devices according to the invention to have two pump impellers together to form an electromotor and rotate in opposite directions, to provide another pump impeller in the passageway of the one pump impeller or in the passageways of both pump impellers in order to form in turn an electromotor together with the housing. In this case, the first pump impeller could be activated or deactivated in case of necessity, thereby permitting the capacity of the passageway, in which a pump impeller conveys in direct cooperation with another pump impeller, to be varied and regulated independently of the capacity relationships which exist due to the cooperation of the pumps forming an electromotor.

A constructively favorable arrangement is attained if the poles are designed as permanent magnetic poles on one of the cooperating pole support parts forming an electromotor. When the poles are designed as electromagnetic poles, a supply of current is necessary. In the case of rotating parts, sliding contact means are required, of which as few as possible should be employed. In the case of two cooperating pole supports, it is therefore favorable to equip only one with electromagnets and the other with permanent magnetic poles.

Other features and advantages of the invention will result from the patent claims and from the following description of embodiments in conjunction with the drawings, in which:

Figure 1:
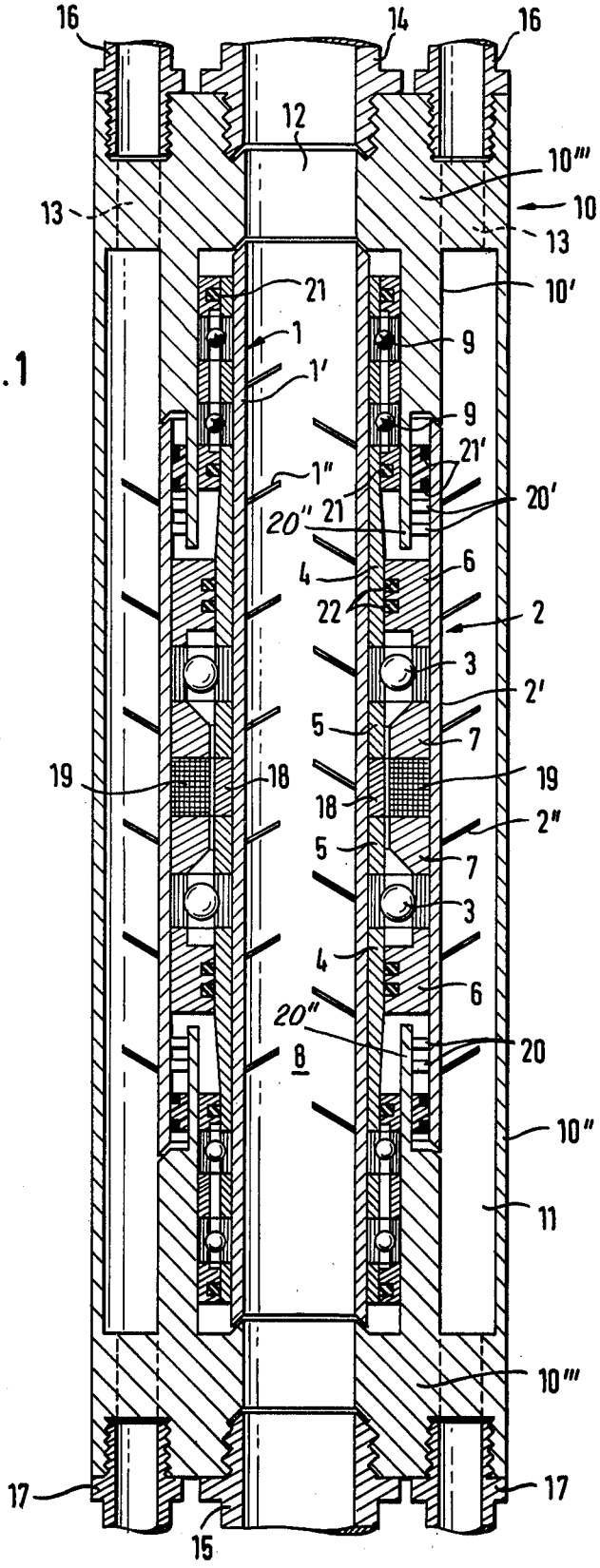
FIG. 1 is an axial longitudinal section through an inventive pumping device in accordance with a first embodiment.

A first embodiment of the pumping device is illustrated in FIG. 1 in an axial longitudinal section. This embodiment is designed as a "pipe pump" having a circular cylindrical external shape. The pumping device has two pump impellers 1 and 2 which are disposed to be coaxially rotatable about an imaginary axis of rotation. The internal pump impeller 1 consists of a pipe 1' arranged coaxially with respect to the imaginary axis of rotation and pump surfaces 1'' are located on the inner periphery of the same in the form of propeller vanes. The external pump impeller consists of a pipe 2' coaxially surrounding in a radially spaced relation the pipe 1' of said internal pump impeller and being provided externally with pump surfaces 2'' secured to the outer periphery of the pipe 2' in the form of propeller vanes. The circular cylindrical pipes 1' and 2' of the internal pump impeller 1 or of the external pump impeller 2 are rotatably supported on and relative to one another by means of ball bearings 3 which are capable of absorbing axial forces as well. The ball bearings 3 are secured in place, e.g. by screwing, on the pipe 1' or 2' by means of spacing rings 4 or 5.

The pipe 1' of the internal pump impeller 1 defines a first passageway 8. The pipe 1' is rotatably supported at both ends on a sleeve-shaped part 10' of a housing 10 via ball bearings 9 which are also capable of transmitting axial forces. The housing 10 includes a circular cylindrical jacket 10'' which jacket coaxially surrounds the pump impellers 1 and 2 in radially spaced relation and which defines the external boundary of a second passageway 11. Internally this passageway 11 is defined by the outer periphery of the pipe 2' of the external pump impeller and by the outer periphery of the sleeves 10' of the housing 10. The housing 10 also has at both ends a support part 10''' respectively which on the one hand supports the sleeve 10' and by it and the bearings 9 supports the pump impellers 1 and 2 and which on the other hand, is provided with passageways 12 and 13 which are aligned with the passageways 8 and 11. A plurality of passageways 13 is provided along a circle in the support part 10''' in order to achieve the most uniform possible distribution of the medium over the periphery of the passageway 11 which has a circular cross-section.

The outer openings of the passageways 8 and 11 in each support part 10''', i.e., the openings of passageways 12 and 13, are designed such that connection lines may be attached in a simple and easy manner. Bores provided with internal threads into which screw sockets of the connection lines may be screwed are provided in the illustrated embodiment for this purpose. The pump device can thus be connected quickly to lines as well as disconnected therefrom. The lines 14 and 15 serve to supply or remove the medium to be conveyed through the internal pump impeller 1. In order to supply the medium to be conveyed through the external pump impeller 2, a plurality of supply lines 16 or discharge lines 17 are provided which are attached to the individual passageways 13. Instead of this plurality of supply 16 and discharge lines 17, it would also be possible by way of example to provide only one supply 16 and discharge line 17 and to distribute the medium to the passageways 13 via an upstream distribution space which is not shown in FIG. 1.

A plurality of permanent magnets 18 is uniformly distributed on the outer periphery of the pipe 1' of the internal pump impeller. These permanent magnets are screwed onto the pipe 1' for example. Positioned opposite these permanent magnets 18 in a slight radially spaced relation is a plurality of electromagnets 19 distributed about the inner periphery of the pipe 2' of the external pump impeller 2 and secured thereto in a suitable manner, for example by screwing. Each of these electromagnets 19 consists of a magnet core which is encompassed by a coil of an electrical conductor wound about it. These electrical leads which are not illustrated in FIG. 1 for the sake of clarity are positioned along the pipe 2' and are led to the sliding contacts 20 or 20' which in turn are in sliding contact with corresponding slip rings 20'' affixed to the sleeves 10' of the housing 10. Leads (not illustrated in FIG. 1 for the sake of clarity) lead away from the slip rings 20'' along the sleeves 10' and through the support parts 10''' of the housing 10 in an outward direction and are led from there to a control device which is not shown for the sake of clarity which causes phase- and time-regulated currents to be applied to the electromagnet 19. Due to this design, the internal pump impeller 1 and the external pump impeller 2 form two pole supports having co-acting poles 18 and 19 and, therefore, an electromotor with two counter-rotating pole supports. The speed and output of the pump impellers 1 and 2 can be influenced by regulating the currents supplied to the electromagnetic poles 19. In so doing, however, the pump impellers will always be dependent on one another such that the torque acting on the pump impeller 1 is always equal to and opposite the torque acting on the pump impeller 2. Due to this dependency, there is also a corresponding dependency of the capacities of the pumps formed by the pump impellers 1 and 2.

Suitable seals 21 or 22 or 21', which may be constructed as floating ring seals, stuffing box seals or labyrinth seals or in another suitable form according to the nature of the media to be conveyed, are respectively provided between the relatively moving or rotating parts, i.e., between the pipe 1' and the sleeve 10' of the housing 10 as well as between the pipe 1' and pipe 2', as well as between the pipe 2' and the sleeve 10'.

As FIG. 1 reveals, the embodiment of the pump device illustrated there has an elongated, circular cylindrical shape which requires very little space. Due to the circular cylindrical shape, the pump device can be introduced into drill holes as well when connected between lines 16 and 17 or 14 and 15.

In the case of the pump device shown in FIG. 1, the pump impellers 1 and 2 operate as pumps connected in parallel and convey the respective medium in a separate passageway. It is also possible, however, to connect the discharge channel 15 via leads with the directly adjacent channels in the support part 10''' leading to the passageway 11. It is possible in this way to allow the pump impellers 1 and 2 to operate as pumps connected in series. In so doing, the pump vanes of the two pump impellers 1 and 2 must be adjusted accordingly.

Figure 2:
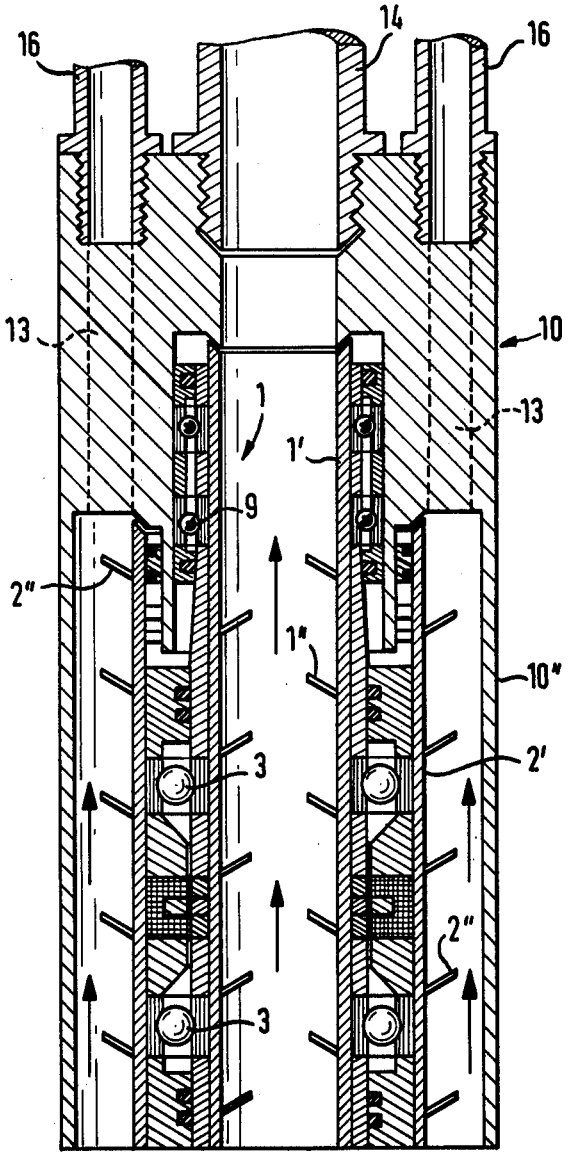
FIG. 2 is a pumping device in accordance with a second embodiment which is modified as compared with FIG. 1.

Another embodiment of a pump device designed as a "pipe pump" is illustrated in FIG. 2. The construction of this pump device corresponds in principle to the structure of the pump device described with reference to FIG. 1. In the case of the embodiment according to FIG. 2, however, one end of the pump device is completely open so that the ends of the passageways of the pump device located there have large suction openings with a circular cross-section or circular ring cross-section at the open end. This embodiment of the pump device may be immersed, for example, into the medium to be conveyed, this medium then being pumped in an upward direction through two separate passageways, i.e. the central passageway and the passageway which surrounds it annularly. The pump device can be hung on the lines which lead to the top and can be lowered into a drill hole, for example, on these lines. During this mode of operation, however, the pumping device only pumps a single medium, but has the great advantage of a very low space requirement as compared to hitherto known pumps.

Figure 3:
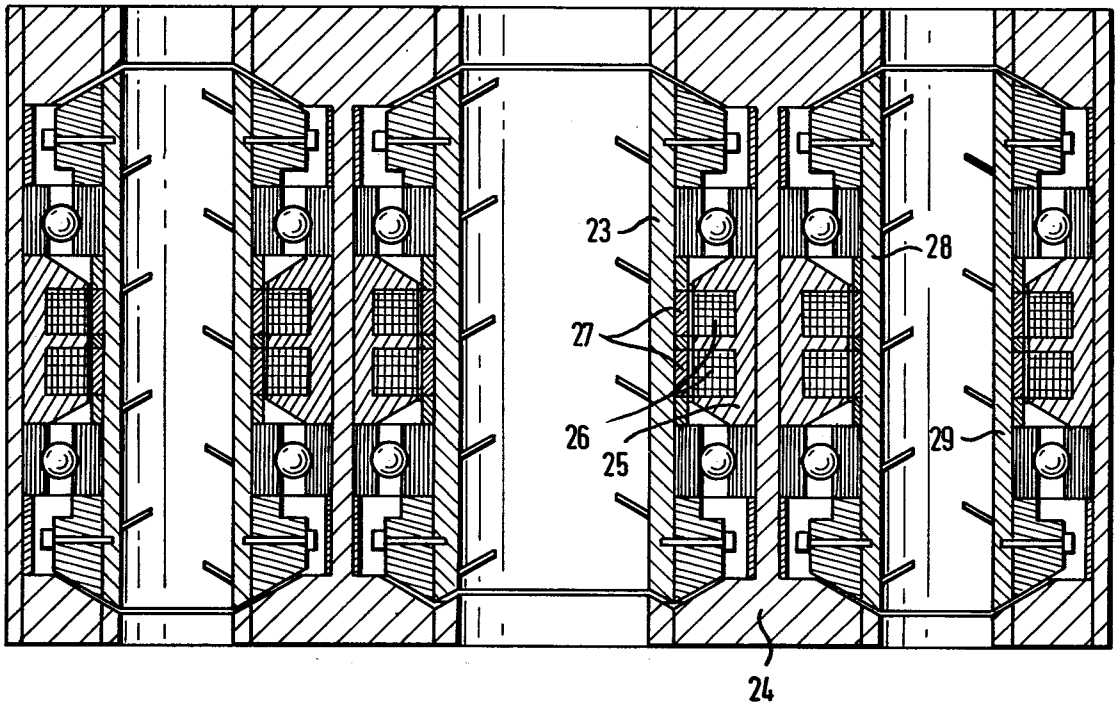
FIG. 3 is an axial longitudinal section through an inventive pumping device in accordance with a third embodiment.

Yet another embodiment of an inventive pumping device is shown in FIG. 3. This embodiment is designed as a "pipe pump" as well. The pumping device has a first central pump impeller 23 formed from a circular cylindrical pipe and radially inwardly projecting pump vanes on the inner side thereof. This impeller 23 is rotatably supported in a housing 24 by means of roller bearings which can absorb both radial as well as axial forces. A pole support 25 is mounted in the housing so as to coaxially encompass the pump impeller 23 in radially spaced relation and supports a double collar of electromagnetic poles 26 on its inner periphery. On the outer circumference of the pump impeller 23, opposite the electromagnetic poles 26, permanent magnetic poles 27 are arranged in a double collar. The electromagnetic poles 26 each consist of an iron core and a coil of conducting wire wound thereabout. The conducting coils are connected via lines which are not illustrated in FIG. 3 for the sake of clarity and which are positioned in the housing 24 in a stationary manner with a control device which is not illustrated for the sake of clarity and which in turn is connected to a voltage source. The electromagnetic poles are acted upon via the control device by currents which are frequency- and phase-regulated. The pump impeller 23 thus forms an electromotor together with the pole support 25 of the housing 24, the housing 24 being the stator and the pump impeller 23 being the rotor of said electromotor. In this design, the pump impeller 23 rotates relative to the housing. Another pump impeller 28 is rotatably journaled in the housing 24 coaxially to the pump impeller 23. This pump impeller 28 defines the inner periphery of a second passageway which is independent of the passageway defined by the pump impeller 23. The pump impeller 28 also bears a double collar of permanent magnetic poles which cooperate with an opposing double collar of electromagnetic poles which are mounted in the housing 24. In this way the pump impeller 28 also forms an electromotor together with the housing. The electromagnetic poles of this electromotor are also connected with the afore-cited control device. The electromagnetic poles can be acted upon by the control device irrespectively of the electromagnetic poles 26 which drive the pump impeller 23. In such a case, the pump impeller 28 rotates completely independently of the pump impeller 23. It is also possible, however, to permit the same currents to act on the electromagnetic poles for driving the pump impeller 28 in parallel with respect to the electromagnetic poles 26 of the pump impeller 23.

The outer circumference of the passageway in which the pump impeller 28 operates, is defined by the pipe of another pump impeller 29 whose operating surfaces are directed in a radial inward direction toward the pump impeller 28 and which is rotatably supported in the housing 24 just like the other pump impellers. This pump impeller also supports a double collar of permanent magnetic poles which cooperate with corresponding electromagnetic poles mounted in the housing 24, thereby forming an electromotor. The electromagnetic poles disposed to drive the pump impeller 29 are coupled with the aforementioned control device via lines not shown for the sake of clarity. In this embodiment, it is possible to vary within wide limits the capacity in the passageway with a circular ring cross-section, in which both the pump impeller 28 as well as the pump impeller 29 operate, by stopping either the pump impeller 28 or 29 completely and permitting only the other respective pump impeller to run or to vary and regulate the speed of one or both of the pump impellers 28 and 29 by correspondingly regulating the current which is conducted through the electromagnetic poles. In this embodiment as well, the pump device has a circular cylindrical outer shape and a low space requirement. This pump device is therefore also suitable to pump out drill holes, in particular for being introduced into the bottoms of drill holes.

Figure 4:
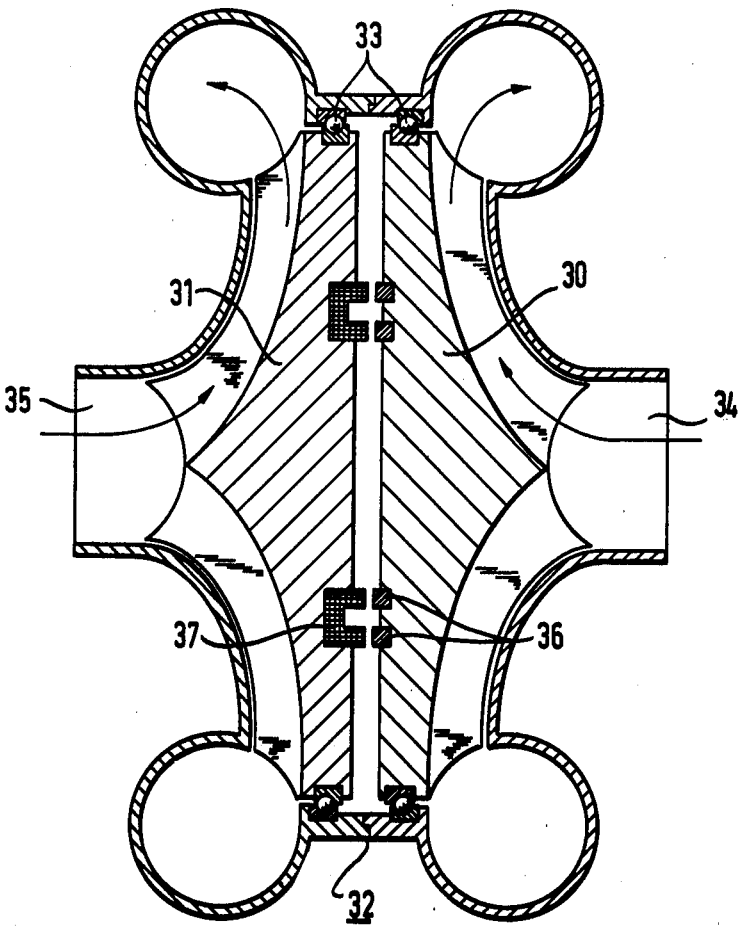
FIG. 4 is a schematic axial longitudinal section through an inventive pumping device in accordance with a fourth embodiment.

Another embodiment of the inventive pumping device is shown schematically in an axial longitudinal section in FIG. 4. This embodiment includes two pump impellers 30 and 31 which are constructed as the pump impellers of conventional radial pumps. The pump impellers are arranged coaxially and are rotatably mounted in a housing 32 which surrounds them by means of rolling bearings 33, which can absorb both axial and radial forces, such that the suction channels 34 and 35 of the two pump impellers extend in opposite directions in the direction of the axis. The rear sides of the pump impellers are adjacent one another and each supports one pole collar respectively. The pole collar of the one pump impeller 30 consists of permanent magnets 36, the pole collar of the other pump impeller 31 consists of electromagnets 37. The electromagnets 37 in turn consist of an iron core and a coil wound thereabout respectively. All coils are connected via lines not shown for the sake of clarity with a control device which is not shown either. The control device is in turn connected with a voltage source and permits the electromagnetic poles 37 to be acted upon by currents which are regulated with respect to their frequency and phase shift. The supply of the currents to the poles must be effected by slip rings (not shown), since the pump impeller 31 rotates relative to the housing 32. The slip rings, however, may be designed in the manner common in the art. The pump impellers 30 and 31 function as counter-rotating pole supports and together form an electromotor. By means of this embodiment of the inventive pumping device, it is possible to pump 2 different media through two separate passageways and to convey them to their respective destinations. The housing 32 has on the outer periphery of each pump impeller 30 or 31 a discharge volute which forms one part of the passageway of the respective pump impeller and which is separated from the other respective discharge volute. Seals which ensure sealing of the passageways with respect to one another are provided between the housing and pump impellers, but are not shown for the sake of clarity. These seals can be designed in a known manner, e.g. as slip ring seals or labyrinth seals, depending on the media to be conveyed. This embodiment of the pumping device also constitutes a very compact, space-saving aggregate. As in the case of the embodiment according to FIG. 1, the capacities conveyed by the pump impellers 30 and 31 are not independent of one another in the embodiment according to FIG. 4, since the pump impellers together form an electromotor and thus the torques transmitted to the pump impellers are respectively equal and opposite.

The invention is not restricted to the examples cited. For instance, it is also possible to dispose an additional pump impeller in the outer passageway 11 in the embodiment according to FIG. 1 which would define the pasageway 11 on its outer periphery and whose vanes would be directed in a radial inward direction. Such an additional pump impeller could be supported in the housing in the same manner as was illustrated in the embodiment in accordance with FIG. 3 for the outermost radial pump impeller 29. Such an additional pump impeller could be driven independently of the pump impellers 1 and 2 of the embodiment in accordance with FIG. 1. It would be possible in this context that this additional pump impeller forms a separate electromotor together with the housing so that the additional pump impeller could be driven independently of the pump impellers 1 and 2. The capacity in the passageway 11 could be varied considerably in this manner and could be maintained within wide limits irrespective of the capacity in the passageway 8.

All features mentioned in the description and in the drawings can also be essential to the invention in any arbitrary combinations.

What is claimed is:

1. An electrical pumping device comprising at least two coaxially rotatable pump impellers, at least two coaxial separate passageways, one impeller positioned within each passageway, pole support parts attached to each of said impellers, said pole support parts forming a part of at least one electromotor and distributed about the axis of rotation in a radially spaced relation, each pump impeller together with adjacent pump impeller forming the counter-rotating parts of an electromotor by cooperation of the pole support parts connected with these pump impellers.

2. The pumping device according to claim 1, including a housing in which the pump impellers are rotatably mounted.

3. The pumping device according to claim 1, wherein each pump impeller includes a pipe with a circular cross-section which is arranged coaxially with respect to the imaginary axis of rotation and on which pipe surfaces are secured which project radially outwardly or radially inwardly.

4. The pumping device according to claim 2, wherein the pipe of each pump impeller is designed as a pole support part.

5. The pumping device according to claim 3, wherein the impellers and their pipes are counter-rotating forming an electromotor, said pipes are rotatably mounted directly abutting on one another.

6. The pumping device according to claim 3, wherein the pump surfaces are designed as propeller vanes.

7. The pumping device according to claim 3, wherein the pump surfaces are designed as screw surfaces or worm surfaces.

8. The pumping device according to claim 1, wherein the common housing has a circular cylindrical jacket which coaxially surrounds the pump impellers and which outwardly defines a passageway with a circular ring cross-section radially outside the pipe of the outermost pump impeller as well as a support part which extends traversely to the imaginary axis of rotation and which is provided with passageway openings corresponding to the passageways of the pump impellers, the pump impellers being rotatably mounted directly or indirectly in said support part.

9. The pumping device according to claim 8, wherein the outer apertures of the pasageway openings of the support part of the housing are designed to be connected to channels leading away therefrom.

10. The pumping device according to claim 9, wherein the housing has connections for connecting lines to or from the individual passageways both at the intake of the pumping device as well as at the outlet thereof.

11. The pumping device according to claim 1, wherein each pump impeller is designed as a radial pump impeller.

12. The pumping device according to claim 1 including a line, the outlet end of the passageway of a pump impeller being connected with the passageway of the adjacent pump impeller via said line.

13. The pumping device according to claim 2, wherein at least one pump impeller is provided whose pole support part cooperates with a pole support part stationarily secured to the housing and forms an electromotor together with said pole support part.

14. The pumping device according to claim 1, wherein the poles on one of the cooperating pole support parts forming an electromotor are designed as permanent magnetic poles.

15. The pumping device according to claim 1 including seals, said seals for mutual sealing being provided on the parts which are rotatable relative to one another.

* * * * *